US007600272B2

(12) United States Patent
Coleman et al.

(10) Patent No.: US 7,600,272 B2
(45) Date of Patent: Oct. 13, 2009

(54) SPA COVER LIFTER AND METHOD

(75) Inventors: John Coleman, Philadelphia, PA (US); Seth Galewyrick, Philadelphia, PA (US); Andrew M. Weiman, Langhorne, PA (US); Andrew Maggion, Skilman, NJ (US)

(73) Assignee: Merlin Technologies, Inc., Hamilton, NJ (US)

( * ) Notice: Subject to any disclaimer, the term of this patent is extended or adjusted under 35 U.S.C. 154(b) by 811 days.

(21) Appl. No.: 11/337,297

(22) Filed: Jan. 23, 2006

(65) Prior Publication Data

US 2006/0162060 A1 Jul. 27, 2006

Related U.S. Application Data

(60) Provisional application No. 60/645,653, filed on Jan. 21, 2005.

(51) Int. Cl.
*E04H 4/06* (2006.01)

(52) U.S. Cl. ..... 4/498

(58) Field of Classification Search ..... 4/498; 318/466, 286

See application file for complete search history.

(56) References Cited

U.S. PATENT DOCUMENTS 4,853,985 A * 8/1989 Perry ..... 4/498
5,783,019 A 7/1998 Pesterfield
5,974,599 A 11/1999 Tudor
5,996,137 A 12/1999 Genova
6,000,071 A 12/1999 Fettes
6,000,072 A 12/1999 LaHay
6,032,305 A 3/2000 Tedrick
6,158,063 A 12/2000 Tudor
6,195,811 B1 3/2001 Dragovic
6,374,433 B1 4/2002 Gray
6,381,766 B1 5/2002 Perry
6,393,630 B1 5/2002 Tedrick
6,550,077 B1 4/2003 Tedrick
6,634,036 B2 10/2003 Tudor
6,665,890 B1 12/2003 Tedrick (Continued)

OTHER PUBLICATIONS

Auto Spa Cover website (http://www.autospacover.com/home_page.htm), 7 pages, visited May 9, 2006.

*Primary Examiner*—Gregory L Huson
*Assistant Examiner*—Karen Younkins
(74) *Attorney, Agent, or Firm*—Panitch Schwarze Belisario & Nadel LLP

(57) ABSTRACT

A spa cover lifter for moving a spa cover from a closed position to a storage position includes a drive mechanism, a fixed base and a lifting arm assembly. The lifting arm assembly is mounted to first or second leaves of the spa cover. The lifting arm assembly is driven by the drive mechanism and is moveably mounted to the fixed base. The lifting arm assembly includes a cover pivoting assembly and a cover transporting assembly. The cover pivoting assembly is driven by the drive mechanism to move the cover from the closed position to an intermediate position and the cover transporting assembly is driven by the drive mechanism to the move the cover from the intermediate position to the storage position. The spa cover lifter has an automatic shutoff for cutting power when an obstacle is encountered. A method of moving the spa cover is also disclosed.

7 Claims, 11 Drawing Sheets

U.S. PATENT DOCUMENTS

| | | | | |
|---|---|---|---|---|
| 6,718,566 | B1 | 4/2004 | Wilson | |
| 6,742,196 | B2 | 6/2004 | LaHay | |
| 6,870,334 | B2 * | 3/2005 | Jurado et al. | 318/282 |
| 6,938,281 | B1 | 9/2005 | Tudor | |
| 7,155,756 | B1 * | 1/2007 | Helder | 4/498 |
| 2003/0150054 | A1 * | 8/2003 | Tudor | 4/498 |
| 2004/0032232 | A1 * | 2/2004 | Murray et al. | 318/434 |
| 2004/0034915 | A1 | 2/2004 | Tedrick | |
| 2004/0143895 | A1 | 7/2004 | Loyd et al. | |
| 2006/0053543 | A1 | 3/2006 | Vargas et al. | |
| 2007/0210290 | A1 * | 9/2007 | Koren | 254/264 |
| 2008/0060125 | A1 * | 3/2008 | Koren | 4/498 |

* cited by examiner

SPA COVER LIFTER AND METHOD

CROSS-REFERENCE TO RELATED APPLICATIONS

This application claims the benefit of U.S. Provisional Patent Application No. 60/645,653, filed Jan. 21, 2005 and entitled "Spa Cover Lifter", which is incorporated herein by reference.

BACKGROUND OF THE INVENTION

The present invention is directed to a spa cover lifter for lifting a spa cover off of a spa and placing the cover in a storage position as well as returning the spa cover from the storage position to a closed position covering the spa. More particularly, the present invention is directed to a spa cover lifter that automatically moves the spa cover to and between the storage and closed positions and a method for moving the spa cover to and between the closed and storage positions.

Spa covers are commonly used to cover the mouth or open end of a spa or whirlpool to prevent people or foreign objects such as leaves, paper or other debris from falling into the water of the spa when the spa is not in use. The spa cover also typically insulates the top of the spa to prevent or reduce the loss of heat from the water.

Modern spa covers are often relatively large and may have a dense or solid construction such that the covers may be walked upon by children, pets or other individuals without structural failure to prevent persons, pets or other items from falling into the spa. The covers are often bulky and dense to provide significant insulating properties and save energy by retaining heat in the spa's water. Moderns spas are often large such that a plurality of users are able to enjoy the spa at the same time and this results in relatively large spa covers to cover the larger opening of the spa. Because of the relatively dense, large and structural nature of the modem spa cover, the covers may be heavy and difficult for an individual to manually remove from the mouth of the spa prior to use or to replace over the spa after use. Difficulty in removing the spa cover is particularly acute for users who have limited strength and/or mobility. Improperly moving the spa cover from the mouth of the spa or storage of the spa cover may result in damage to the spa cover and/or the spa. The modem spa cover may also be relatively expensive due to customization and the relatively large size of the spa cover. As a result, damage or replacement of the modem spa cover results in significant costs to the user.

It is desirable for users to have an automatic spa cover lifter to remove and replace the spa cover and position the spa cover in a convenient storage position. In addition, it is desirable for the spa cover to automatically and repeatedly remove the spa cover from the mouth of the spa and automatically place the spa cover in a storage position such that the spa is convenient to use and the spa cover is not damaged during removal, storage or replacement. Preferably, the spa cover lifter would be able to remove and replace the spa cover in a single operation, without requiring the user to lift or move any portions of the spa cover or the spa. It is also desirable for the mechanical or automatic spa cover lifter to store the spa cover in a relatively compact manner when the spa is in use. It is further desirable that the spa cover lifter is relatively small such that the lifter does not take up a significant amount of space near the spa. Further, it is desirable that the removal and replacement motion of the spa cover is relatively compact such that the spa cover lifter may be installed within a home or structure having a ceiling without concern for clearance issues during the removal and replacement process.

BRIEF SUMMARY OF THE INVENTION

A spa cover lifter for moving a cover from a closed position covering a mouth of a spa to a storage position exposing the mouth of the spa includes a drive mechanism, a fixed base and a lifting arm assembly. The cover includes a first leaf and a second leaf. The lifting arm assembly is mounted to the first leaf or the second leaf, is driven by the drive mechanism and is movably mounted to the fixed base. The lifting arm assembly includes a cover pivoting assembly and a cover transporting assembly. The cover pivoting assembly is driven by the drive mechanism to move the cover from the closed position to an intermediate position and the cover transporting assembly is driven by the drive mechanism to move the cover from the intermediate position to the storage position.

A spa cover lifter is utilized for moving a cover from a closed position covering a mouth of a spa to a storage position exposing the mouth. The cover includes a first leaf, a second leaf and a hinge mounting the first leaf to the second leaf. The spa cover lifter includes a drive mechanism, a fixed base and a lifting arm assembly pivotably mounted to the fixed base and driven by the drive mechanism. The lifting arm assembly includes a cover clamp assembly mounted to the first leaf or the second leaf. The cover clamp assembly includes a first jaw, a second jaw and a cover clamp arm. The first jaw and second jaw engage and secure the cover clamp assembly to the cover in a grasping position.

A spa cover lifter for moving a cover from a closed position covering a mouth of a spa to a storage position exposing the mouth includes a drive mechanism, a fixed base and a lifting arm assembly. The cover includes a first leaf and a second leaf. The lifting arm assembly is mounted to the first leaf or the second leaf and to the fixed base. The lifting arm assembly is driven by the drive mechanism. A controller is in communication with the drive mechanism and a remote control is in communication with the controller. The remote control sends a signal to the controller to actuate the drive mechanism to drive the lifting arm assembly and automatically move the cover from the closed position to the storage position.

A method of moving a spa cover with a spa cover lifter from a closed position covering a mouth of the spa to a storage position exposing the mouth. The spa includes a first leaf pivotably mounted to a second leaf at a hinge and the spa cover lifter includes a lifting arm assembly, a drive mechanism and a controller. The method includes the steps of positioning the spa cover over the mouth in a closed position such that the first leaf and the second leaf are generally located on a cover plane, actuating the drive mechanism to pivot a second leaf about the hinge and actuating the drive mechanism to pivot the cover to the storage position. A first exposed face of the first leaf and a second exposed face of the second cover face away from the spa in the closed position. In an intermediate position, the first exposed face is facing the second exposed face and the first leaf and the second leaf are positioned generally parallel to the cover plane.

A spa cover lifter has an automatic shutoff for cutting power to the spa cover lifter when an obstacle is encountered while moving the spa cover. The spa cover has a first leaf pivotably mounted to a second leaf. The spa cover lifter includes a lifting arm assembly mounted to the first or second leaves and a drive mechanism coupled to the lifting arm assembly. The drive mechanism drives the lifting arm assembly to move the cover from a closed position to a storage position. A controller is in communication with the drive mechanism and a safety shutoff mechanism is in communication with the controller. The controller disables the drive mechanism based upon a stop signal from the safety shutoff mechanism.

A method of automatically cutting power to a drive mechanism of a spa cover lifter that moves a spa cover from the closed position covering a mouth of a spa to a storage position exposing the mouth of the spa is disclosed. The spa cover lifter includes a lifting arm assembly, a controller and a safety shutoff mechanism. The method includes the steps of positioning the spa cover in the closed position covering the mouth, engaging the spa cover to the lifting arm assembly, actuating the drive mechanism to move the lifting arm assembly and the spa cover, sending a signal from the safety shutoff mechanism to the controller as the spa cover moves from the closed position to the storage position, comparing the signal to a lookup table and sending a stop signal from the controller to the drive mechanism if one of the spa cover and lifting arm assembly encounters an obstacle based upon the comparison.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
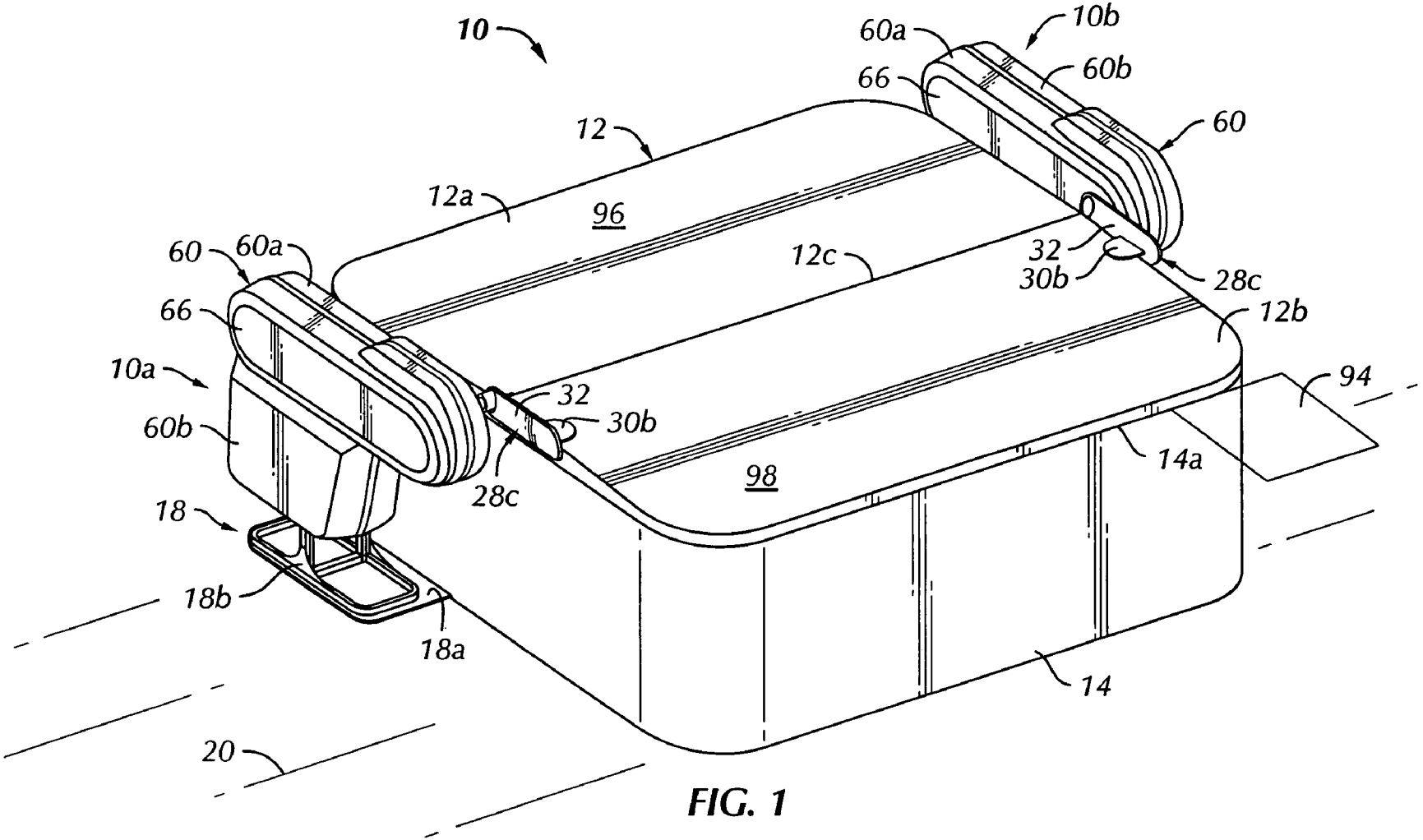
FIG. 1 is a top perspective view of a preferred embodiment of the spa cover lifter of the present invention mounted to a spa cover of a spa.

Certain terminology is used in the following description for convenience only and is not limiting. The words "right", "left", "lower" and "upper" designate directions toward and away from, respectively, the geometric center of the spa, spa cover, spa cover lifter and designated parts thereof. The terminology includes the above-listed words, derivatives thereof and words of similar import. As utilized herein below, the word "assembly" means the putting together of at least two parts or components to make a completed product.

Referring to the drawings in detail, where in like numerals indicate like elements throughout, there is shown in FIGS. 1-13 a preferred embodiment of a spa cover lifter, generally designated 10, for moving a spa cover 12 from a closed position covering a mouth 14*a* of a spa 14 to a storage position exposing the mouth 14*a*. The cover 12 typically includes a first leaf 12*a* and a second leaf 12*b* pivotably mounted to each other at a hinge 12*c*.

Referring to FIG. 1, the spa cover lifter 10 is configured for moving nearly any sized or shaped spa cover 12 from the closed position to the storage position. The spa cover 12 shown in FIG. 1 is of a typical rectangular variety that covers the typical rectangularly-shaped spa 14. The spa cover 12 and spa 14 are not limited to being generally rectangularly-shaped and may be generally circular, oval, square, octagonal or nearly any shape for covering a matingly-shaped spa mouth. The spa cover 12 is shaped to cover the mouth 14*a* of the spa 14 and generally has the same shape as a top of the spa such that the entire mouth 14*a* is covered when the spa cover 12 is in the closed position. In addition, the spa cover 12 is not limited to inclusion of the first and second leaves 12*a*, 12*b* and inclusion of the hinge 12*c*. For example, the spa cover 12 may be circular and generally solid or nearly any shape that covers the mouth 14*a* of the spa 14, however, the preferred spa cover lifter 10 is configured to move the spa cover 12 having the hinge 12*c*. The spa cover lifter 10 is generally able to be configured to operate with nearly any sized and shaped cover 12 as would be obvious to one having ordinary skill in the art. The typical, rectangular-shaped spa 14 and spa cover 14*a*, including the first and second leaves 12*a*, 12*b* and hinge 12*c*, are shown for convenience only and are not meant to be limiting.

The spa cover lifter 10 of the preferred embodiment includes a first lifter portion 10*a* and a second lifter portion 10*b*. The first and second lifter portions 10*a*, 10*b* are preferably positioned on either side of the spa 14 for releasably engaging and automatically moving the spa cover 12, as will be described in greater detail below. The first and second lifter portions 10*a*, 10*b* are preferably mirror images of each other and each include nearly identical components and operate in a nearly identical manner. Accordingly, the first lifter portion 10*a* will be described herein, it being understood that the second lifter portion 10*b* is nearly identical and includes nearly identical components to the first lifter portion 10*a*. The first and second lifter portions 10*a*, 10*b* are preferably positioned at either side of the spa 14 and are removably mounted to the spa cover 12 to cooperatively lift and move the spa cover 12 from opposing sides. The spa cover lifter 10 is not limited to the inclusion of both the first and second lifter portions 10*a*, 10*b* and could be adapted to include only one of the first or second lifter portions 10*a*, 10*b* positioned at one side of the spa 14 for lifting and moving the cover 12. However, both the first and second lifter portions 10*a*, 10*b* are preferred to prevent the cover 12 from being lifted in a cantilever fashion and to generally improve the stability and repeatability of moving the cover 12.

Referring to FIGS. 1-7, the spa cover lifter 10 is utilized to move the cover 12 from a closed position (FIG. 1 and dashed in FIG. 5) covering the mouth 14*a* of the spa 14 to a storage position (dashed in FIG. 7) exposing the mouth 14*a*. As was described above, the first lifter portion 10*a* will be utilized to describe the structure and operation of the spa cover lifter 10, it being understood that the spa cover lifter 10 typically includes the second lifter portion 10*b*. Like reference numerals are utilized to identify like elements of the first and second lifter portions 10*a*, 10*b*, throughout the specification.

Referring to FIGS. 1-7 and 12, the spa cover lifter 10 includes a drive mechanism 16 and a fixed base 18. In the preferred embodiment, the drive mechanism 16 is comprised of a linear actuator 16 that is pivotally mounted to the fixed base 18. The drive mechanism 16 is not limited to being comprised of the linear actuator 16 and may be comprised of nearly any mechanism that is able to provide motive power for driving the spa cover lifter 10 to move the spa cover 12. For example, the drive mechanism 16 may be comprised of a motor that moves the spa cover lifter 10 to move the spa cover 12 or nearly any other mechanism that is able to drive the spa cover lifer 10. In addition, the drive mechanism or linear actuator 16 is not limited to being pivotably mounted to the fixed base 18 and may be fixedly secured to the fixed base 18 or otherwise mounted to the spa 14 or a support surface 20 in order to drive the spa cover lifter 10 to move the spa cover 12. For example, the drive mechanism 16 may be fixedly mounted to the spa 14 to drive the spa cover lifter 10 and spa cover 12, as would be obvious to one having ordinary skill in the art.

The fixed base 18 preferably secures the spa cover lifter 10 in position relative to the spa 14 and spa cover 12 and includes a base plate 18*a*, an upstanding leg 18*b* and a generally horizontal leg 18*c*. The base plate 18*a* is preferably secured to the support surface 20, the upstanding leg 18*b* preferably extends generally perpendicularly from the base plate 18*a* and the horizontal leg 18*c* is preferably positioned generally perpendicular relative to the upstanding leg 18*b* or generally parallel to the base plate 18*a*. The preferred fixed base 18 and base plate 18*a* are fixed to the support surface 20 by positioning a portion of the base plate 18*a* under the spa 14, which sandwiches the base plate 18*a* between the spa 14 and the support surface 20. The fixed base 18 is not limited to being fixedly secured or otherwise secured to the support surface 20 by being sandwiched between the spa 14 and the support surface 20 and may be otherwise fastened, bolted, adhesively bonded or secured to the support surface 20. In addition, the fixed base 18 is not limited to being secured to the support surface 20 and may be secured to a side of the spa 14, internally within the spa 14 or to another component that is mounted in a generally fixed position relative to the spa 14. The fixed base 18 is preferably constructed of a metallic material such as aluminum or steel but is not so limited. For example, the fixed base 18 may be constructed of a composite and/or polymeric material or nearly any generally rigid, structural material that is able to take on the general shape of the fixed base 18 and withstand the normal operating conditions of the fixed base 18.

Referring to FIGS. 3-7 and 12, the linear actuator 16 is preferably pivotally mounted to the fixed base 18. Specifically, the linear actuator 16 is pivotably mounted to an actuator mount beam 22 that is mounted to a pivoting bracket 24, which is in turn pivotably mounted to the horizontal leg 18*c*. In the preferred embodiment, the actuator mount beam 22 is mounted between a pair of legs of the U-shaped pivoting bracket 24 at an opposite end of the legs from where the pivoting bracket 24 is pivotably mounted to the horizontal leg 18*c*. The actuator mount beam 22 and pivoting bracket 24 are preferably constructed of a relatively stiff, structural material that is able to withstand the normal operating conditions of the spa cover lifter 10. The actuator mount beam 22 and pivoting bracket 24 are preferably constructed of steel or aluminum but are not so limited. The actuator mount beam 22 and the pivoting bracket 24 may be constructed of composite, polymeric, wood or other structural, generally rigid materials that are able to take on the general shape of the actuator mount beam 22 and pivoting bracket 24 and withstand their normal operating conditions.

Figure 3:
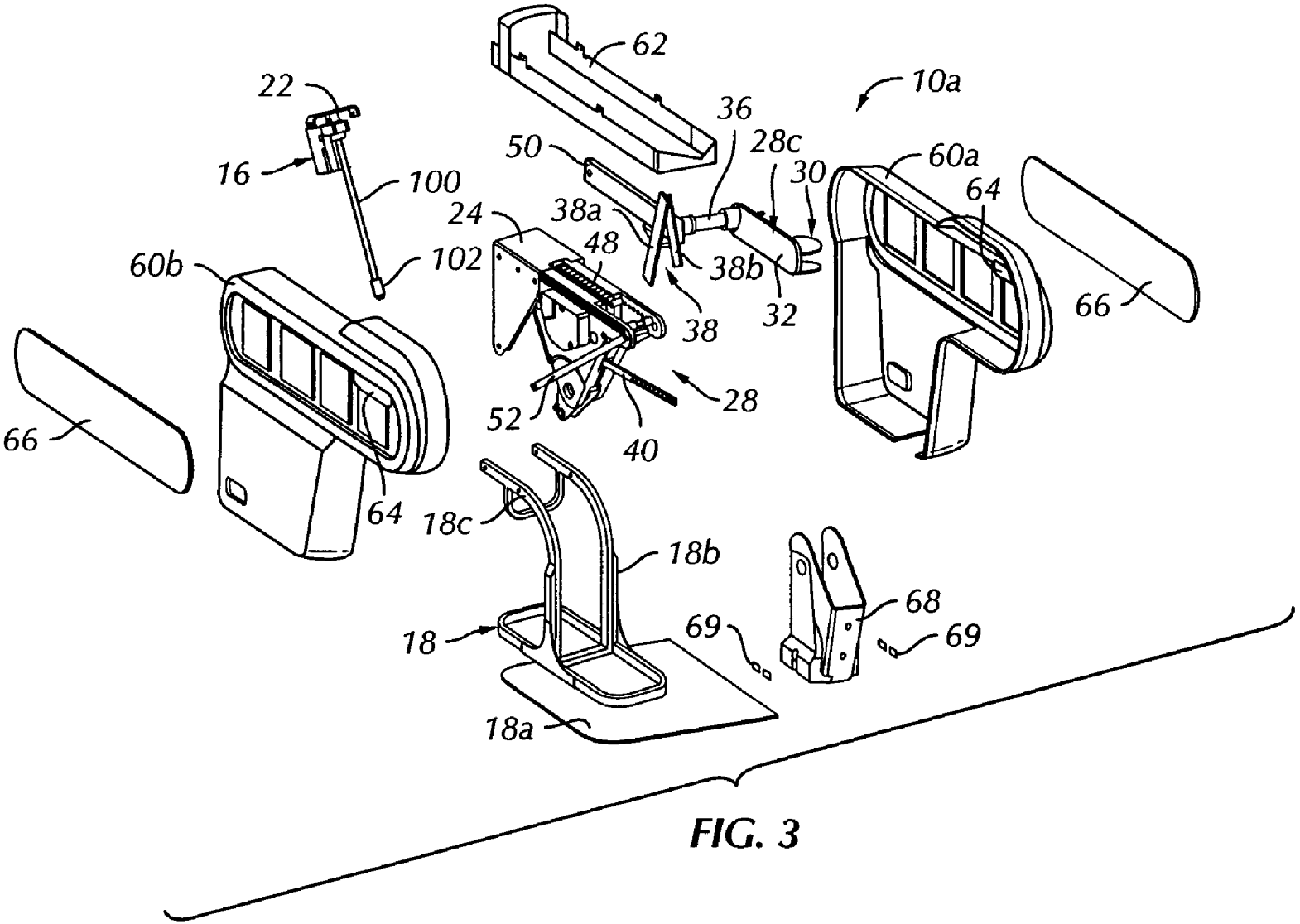
FIG. 3 is a partially exploded view of the first lifter portion of the spa cover lifter of FIG. 1.
Figure 4:
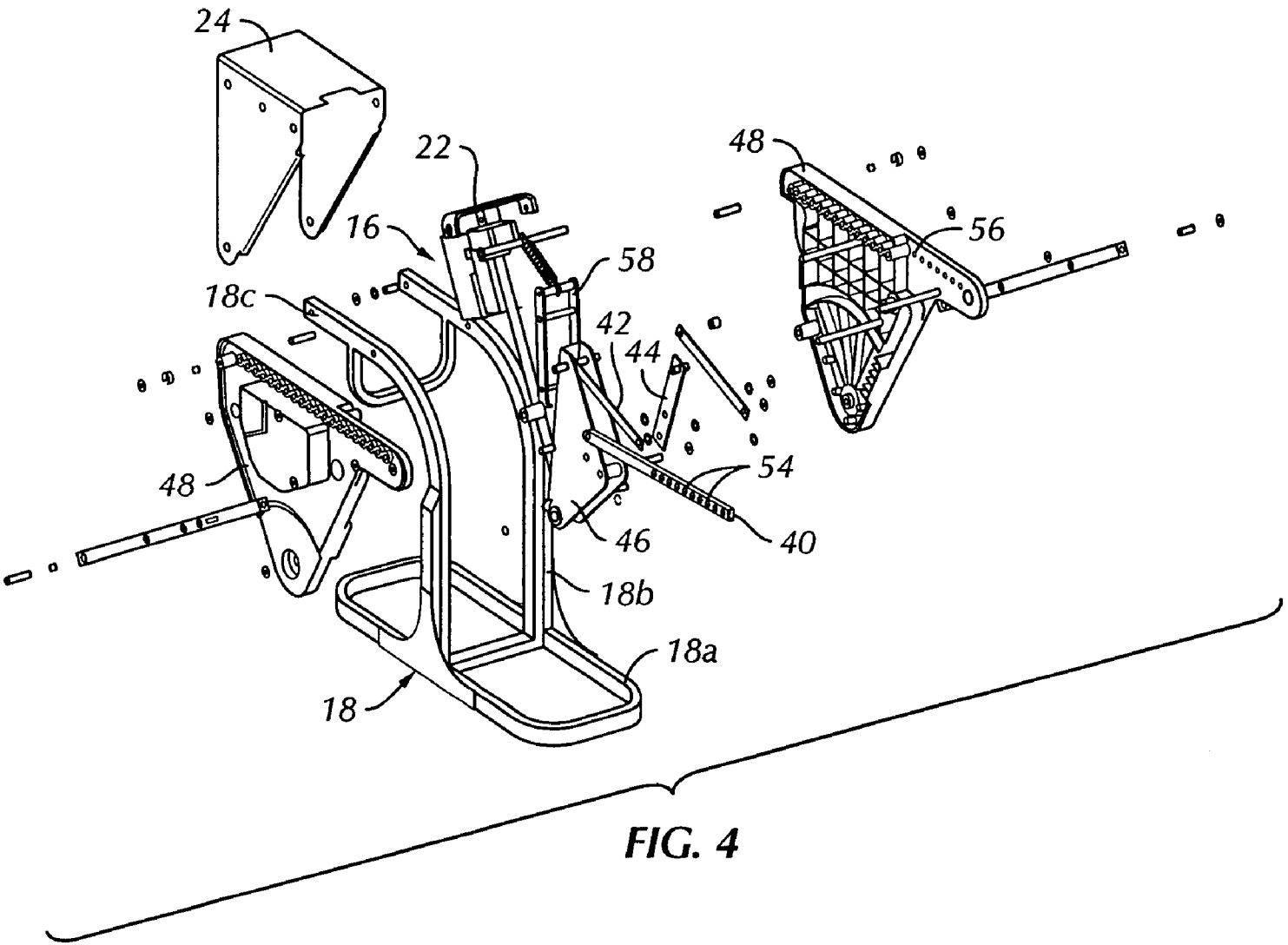
FIG. 4 is a partially exploded view of the first lifter portion of the spa cover lifter shown in FIG. 1, with several components removed for clarity.
Figure 12:
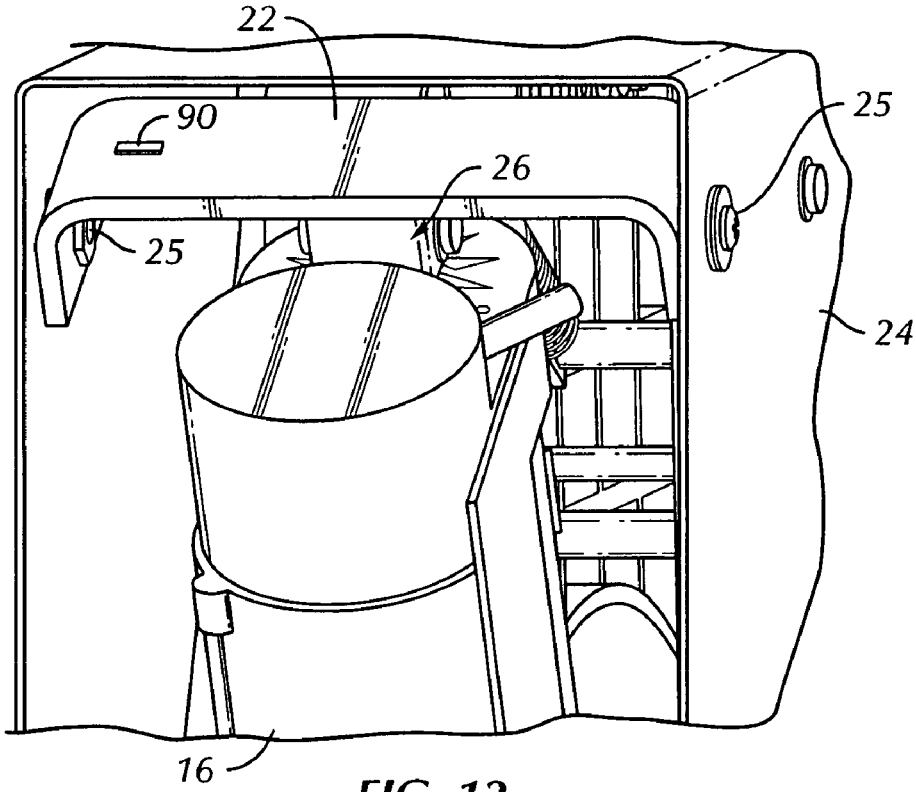
FIG. 12 is a greatly magnified rear perspective view of the first lifter portion of the spa cover lifter shown in FIG. 1 with several components removed for clarity.

Referring to FIGS. 3, 4 and 12, the generally U-shape of the pivoting bracket 24 permits mounting of the actuator mount beam 22 and the linear actuator 16 between its legs to provide stiffness and strength for the pivoting bracket 24 and may partially protect the linear actuator 16. In the preferred embodiment, a significant portion of the linear actuator 16 is positioned between the upstanding legs of the pivoting bracket 24 and may prevent contact or general access to the linear actuator 16 during use. The pivoting bracket 24 is pivotably mounted to a terminal end of the horizontal leg 18*c* at terminal ends of its legs to permit pivoting of the pivoting bracket 24 about the fixed base 18 at a first pivoting joint 24*a*, as will be described in greater detail below.

In the preferred embodiment, the linear actuator 16 is pivotably mounted to the actuator mount beam 22 by a pin and lug mechanism 26. The pin and lug mechanism 26 is generally well known to one having ordinary skill in the art and fixes the linear actuator 16 to the actuator mount beam 22. The actuator mount beam 22 is, in turn, pivotably mounted to the pivoting bracket 24 at its ends by pivot pins 25. Accordingly, the actuator mount beam 22 and linear actuator 16 are able to pivotably move relative to the pivoting bracket 24 during operation of the spa cover lifter 10. The linear actuator 16 and actuator mount beam 22 are not limited to being pivotably mounted to the pivoting bracket 24 by the pivot pins 25 and may be otherwise secured to the pivoting bracket 24. The actuator mount beam 22 and linear actuator 16 are preferably pivotably mounted to the pivoting bracket 24 such that forces from the linear actuator 16 are introduced into the actuator mount beam 22, generally perpendicular it an attachment face of the actuator mount beam 22 such that the beam 22 acts as a bending beam, as will be explained in greater detail below and is generally understood by one having ordinary skill in the art.

Referring to FIGS. 1 and 3-7, the spa cover lifter 10 includes a lifting arm assembly 28 that is mounted to the first leaf 12*a* or the second leaf 12*b*. The lifting arm assembly 28 is preferably comprised of an assembly of arms, links, bars, brackets, clamps and related components that are driven by the drive mechanism 16 to move the spa cover 12 from the closed position to the storage position. The lifting arm assembly 28 is not limited to the specific structure or assembly that is described below and may be comprised of nearly any component or assembly of components that is able to be driven by the drive mechanism 16 to move the spa cover 12 to and between the closed and storage positions. The lifting arm assembly 28 is movably mounted to the fixed base 18 in the preferred embodiment.

Referring to FIGS. 3-7, the preferred lifting arm assembly 28 includes a cover pivoting assembly 28*a* and a cover transporting assembly 28*b*. The cover pivoting assembly 28*a* is driven by the drive mechanism 16 to move the cover 12 from the closed position (FIG. 1) to an intermediate position (dashed in FIG. 6). The cover transporting assembly 28*b* is driven by the drive mechanism 16 to move the cover 12 from the intermediate position to the storage position (dashed in FIG. 7). The lifting arm assembly 28 is preferably mounted between the fixed base 18 and the cover 12 and, specifically, is preferably mounted between the second leaf 12*b* and the horizontal leg 18*c*.

Referring to FIGS. 1-3 and 8-11, in the preferred embodiment, the lifting arm assembly 28 includes a cover clamp assembly 28*c*. The cover clamp assembly 28*c* is comprised of a portion of the cover pivoting and lifting assemblies 28*a*, 28*b* that is utilized to move the cover 12 to and between the closed and intermediate positions and to support the cover 12 as it moves to and between the intermediate and storage positions. The cover clamp assembly 28*c* is preferably, removably mounted to the cover 12 and includes a clamp 30, a cover clamp arm 32, pivot pins 34 and a pivot shaft 36. The clamp 30 is preferably removably mountable to the cover 12 and the pivot shaft 36 is preferably removably mounted to the cover clamp arm 32. The pivot shaft 36 is not limited to being removably mountable to the cover clamp arm 32 and the clamp 30 is not limited to being removably mountable to the cover 12. For example, each of these components may be fixedly mounted to each other. The components of the cover clamp assembly 28*c* are preferably constructed of a generally rigid, structural material, for example, aluminum, steel, wood, polymeric, composite or other like materials.

Referring to FIGS. 3-7 in the preferred embodiment, the cover pivoting assembly 28*a* includes a triangular linkage 38 that has a generally triangular-shape when viewed in the storage position (FIG. 7), a slotted bar 40, a first actuator bar 42, a second actuator bar 44 and an actuator fitting 46. The preferred components of the cover pivoting assembly 28*a* are constructed of a generally rigid, structural material that is able to withstand the normal operating conditions and loads placed upon the components during operation of the spa cover lifter 10. Specifically, the preferred components of the cover pivoting assembly 28*a* are constructed of a metallic, for example, aluminum or steel, material. The cover pivoting assembly 28*a* is preferably mounted at one end to the linear actuator 16 to aid in moving the cover 12 between the closed and intermediate positions.

The preferred cover transporting assembly 28*b* includes the actuator fitting 46, a first bracket 48, an extension arm 50, a first linkage 52 and the pivoting bracket 24. The pivoting bracket 24 and first linkage 52 are preferably, pivotably mounted to the fixed base 18. Specifically, the pivoting bracket 24 and first linkage 52 are preferably, pivotably mounted at their lower ends to the horizontal leg 18*c* at first and second pivot joints 24*a*, 52*a*. The preferred cover transporting assembly 28*b* includes two first linkages 52 and two first brackets 48. Specifically, the two first linkages 52 are pivotably mounted to the horizontal leg 18*c* at opposing second pivoting joints 52*a* and to the ends of the first brackets 48 at an opposite end having a linkage pivoting joint 52*b*. A left-side first linkage 52 is also pivotally mounted to the extension arm 50 at the linkage pivoting joint 52*b* of the first lifter portion 10*a*. The second lifter portion 10*b* is preferably arranged in an opposite manner such that the right-side first linkage 52 is pivotably mounted to both the first bracket 48 and extension arm 50 because the right-side of the second lifter portion 10*b* is proximate the spa 14 in the preferred embodiment. The extension arm 50 is preferably mounted to the first bracket 48 at only one side of the first or second lifter portions 10*a*, 10*b* to accommodate mounting of the clamp cover assembly 28*c* to the cover pivoting and cover transporting assemblies 28*a*, 28*b*, as will be understood by one having ordinary skill in the art.

Referring to FIGS. 1-11, the preferred triangular linkage 38 includes a first arm 38*a*, a second arm 38*b* and a third arm 38*c*. The cover clamp arm 32 is pivotably mounted to a terminal end of the extension arm 50 and the third arm 38*c* is fixed to the pivot shaft 36. In the preferred embodiment, the third arm 38*c* is secured to the cover clamp arm 32 in the working position by the pivot shaft 36. In the preferred embodiment, the extension arm 50 is fixed at one side to the first bracket 48 and the pivot shaft 36 preferably extends through an opposite end of the extension arm 50 such that the third arm 38*c*, pivot shaft 36 and cover clamp arm 32 are each pivotably mounted to the extension arm 50. The pivotable mounting of the third arm 38*c*, pivot shaft 36 and cover clamp arm 32 to the extension arm 50 permits pivotable movement of the cover clamp assembly 28*c* relative to the cover transporting assembly 28*b* and, specifically, the extension arm 50 while moving the spa cover 12 between the closed and intermediate positions. In the preferred embodiment, the pivot shaft 36 is pivotably mounted relative to the extension arm 50 by a bearing (not shown). However, the pivot shaft 36 is not limited to being pivotably mounted to the extension arm 50 by the bearing and may be pivotably mounted to the extension arm 50 by a bushing or in nearly any other alternative manner that permits pivotable movement of the third arm 38*c*, pivot shaft 36 and cover clamp arm 32 relative to the extension arm 50.

Referring to FIGS. 3-7, the slotted bar 40 preferably includes a first plurality of adjustment holes 54 along its length and the first bracket 48 preferably includes a second plurality of adjustment holes 56. The first plurality of adjustment holes 54 are preferably utilized to pivotably mount the slotted bar 40 to an end of the first arm 38*a* of the triangular linkage 38 and the second plurality of adjustment holes 56 are preferably utilized to adjustably mount the extension arm 50 to the first bracket 48. Specifically, the first and second plurality of adjustment holes 54, 56 permit adapting the spa cover lifter 10 for use with different sized or different length spa covers 12. That is, depending upon the size, length or shape of the spa cover 12 and spa 14, the fixed base 18 may need to be located at various distances from the cover clamp assembly 28*c*, which is mounted to the spa cover 12. Accordingly, the first and second plurality of adjustment holes 54, 56 permit adjustable mounting of the extension arm 50 and triangular linkage 38 relative to the fixed base 18 such that the cover clamp assembly 28*c* may be positioned at different locations relative to the fixed base 18 and the spa cover 12.

Figure 5:
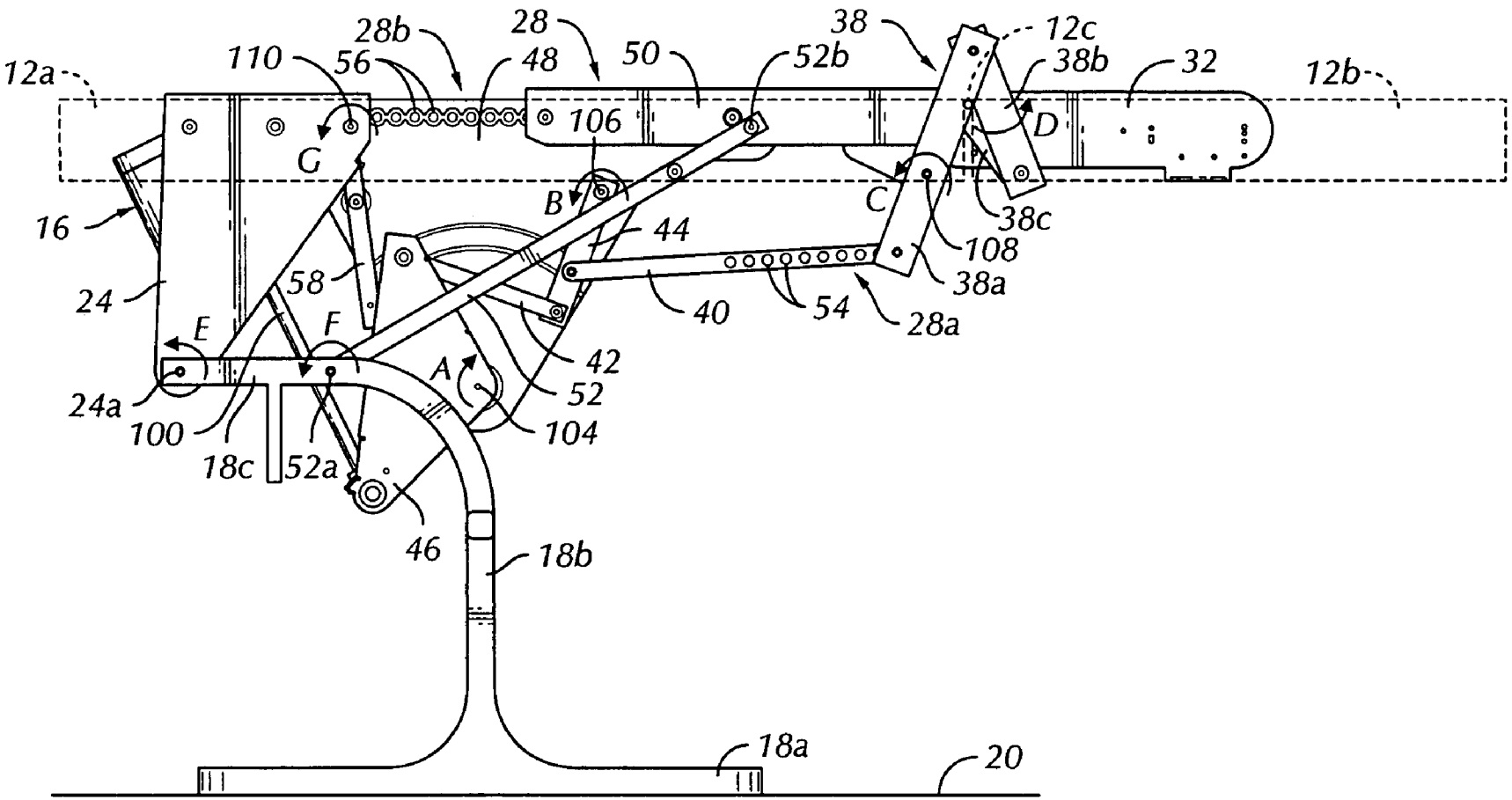
FIG. 5 is a right-side elevational view of the first lifter portion of the spa cover lifter shown in FIG. 1 with several components removed for clarity, the first lifter portion being in a closed position.
Figure 6:
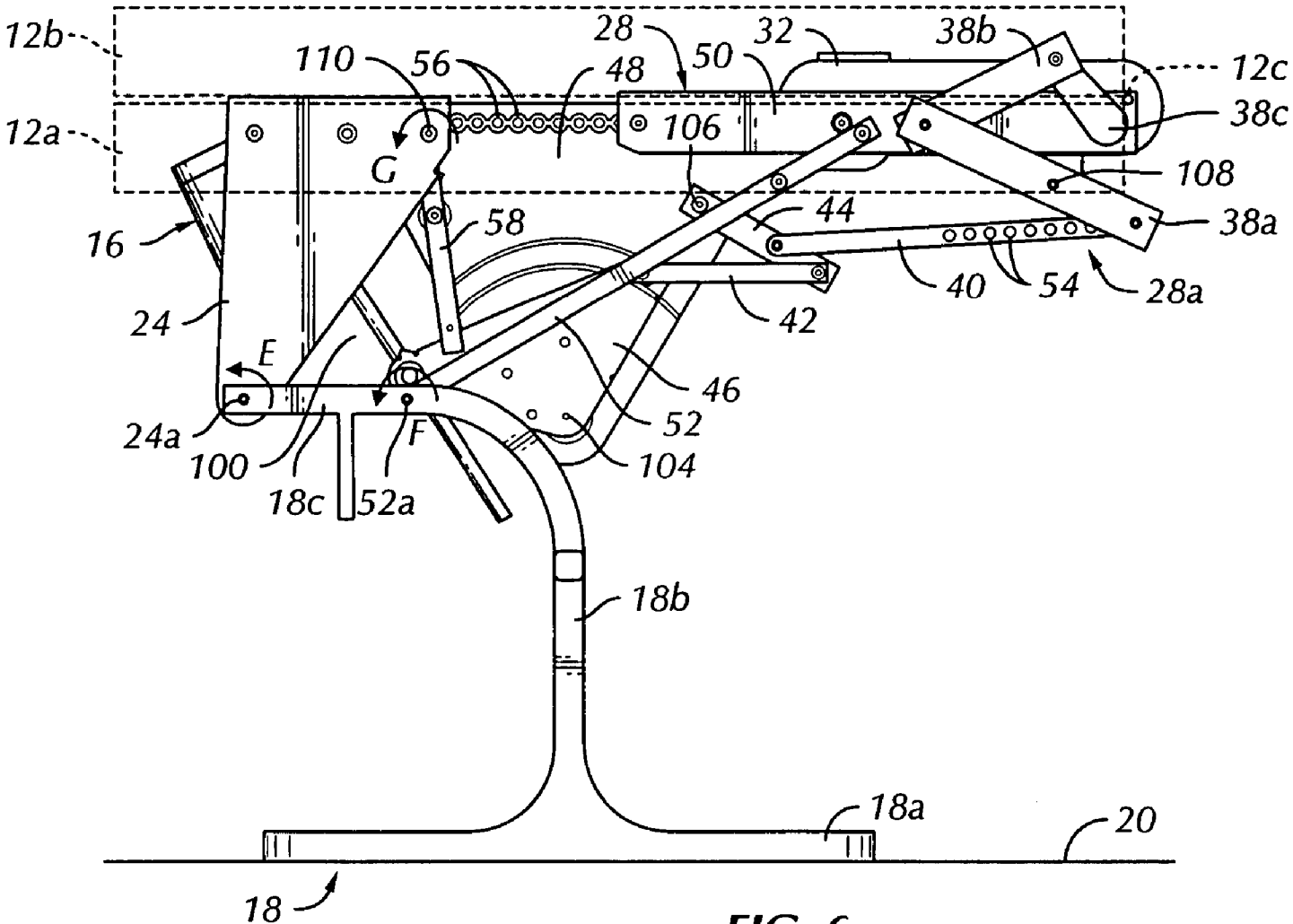
FIG. 6 is a right-side elevational view of the first lifter portion of the spa cover lifter shown in FIG. 1 with several components removed for clarity, the first lifter portion being in an intermediate position.
Figure 7:
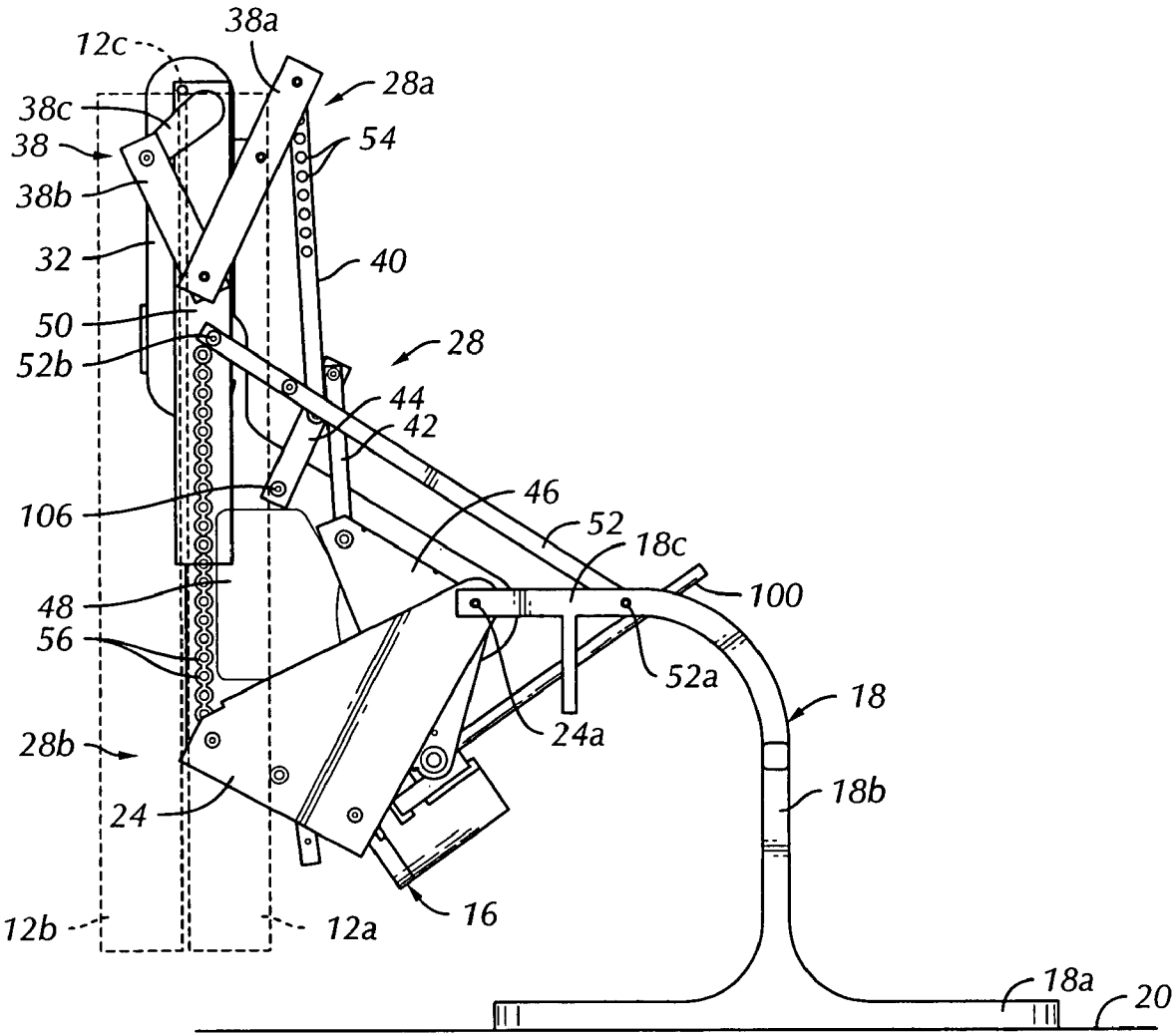
FIG. 7 is a right-side elevational view of the first lifter portion of the spa cover lifter shown in FIG. 1 with several components removed for clarity, the first lifter portion being in a storage position.
Figure 8:
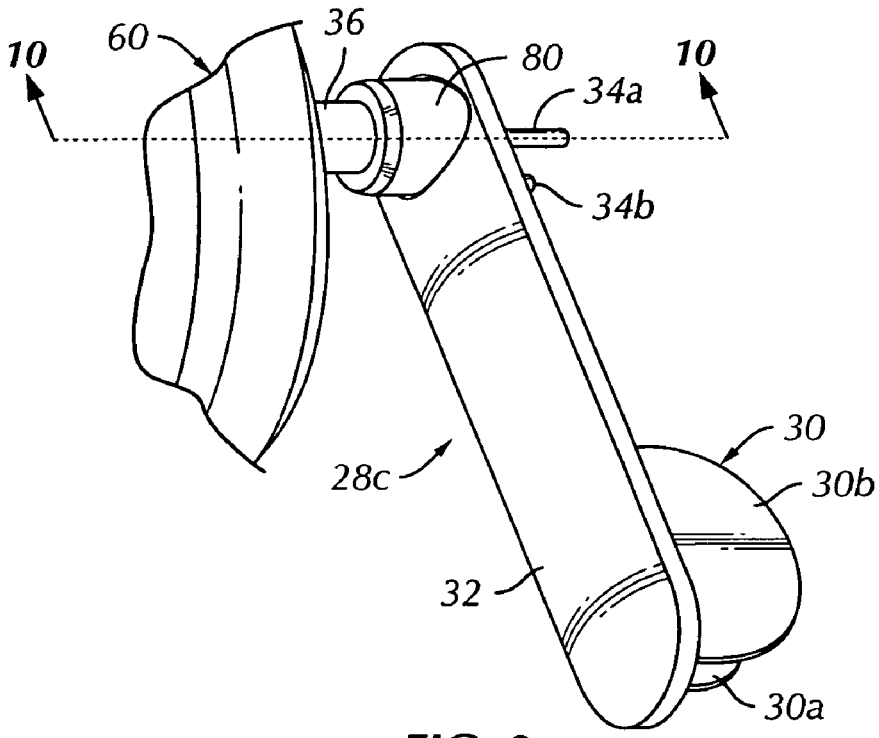
FIG. 8 is a top perspective view of a cover clamp assembly of the first lifter portion of the spa cover lifter shown in FIG. 1.

Referring to FIGS. 5-7, the triangular linkage 38 and extension arm 50 are positioned at their greatest distance from the fixed base 18 on the extreme first and second plurality of adjustment holes 54, 56. One having ordinary skill in the art would understand based upon the present disclosure how the triangular linkage 38 and extension arm 50 may be alternatively mounted at the first and secondary plurality of adjustment holes 54, 56 to accommodate alternatively sized spa covers 12. In addition, one having ordinary skill in the art will realize that the spa cover lifter 10 is not limited to the inclusion of the first and second plurality of adjustment holes 54, 56. For example, the spa cover lifter 10 may be constructed and arranged for a specific spa 14 and spa cover 12, thereby eliminating the need for adjustability of the location of the cover clamp assembly 28*c* relative to the fixed base 18. However, the first and second plurality of adjustment holes 54, 56 positioned along the lengths of the slotted bar 40 and first bracket 48 are preferred such that the spa cover lifter 10 may be adjusted or adapted for use with variably sized or height spa covers 12 and spas 14.

Referring to FIGS. 4-7, in the preferred embodiment, a lock arm 58 is mounted between the cover pivoting assembly 28*a* and the cover transporting assembly 28*b*. The lock arm 58 preferably inhibits movement of the cover pivoting assembly 28*a* relative to the cover transporting assembly 28*b* when the cover 12 is in and moving between the intermediate and storage positions. The lock arm 58 is preferably pivotably mounted to the first bracket 48 and actuator fitting 46. During operation, when the spa cover lifter 10 reaches the intermediate position, the lock arm 58 locks the position of the actuator fitting 46 relative to the first bracket 48 to generally prevent movement of the cover pivoting assembly 28*a* relative to the cover transporting assembly 28*b*, as will be described in greater detail below. The lock arm 58 is preferably mounted between the pair of first brackets 48 and at a lower end (FIG. 5) of the actuator fitting 46.

Figure 2:
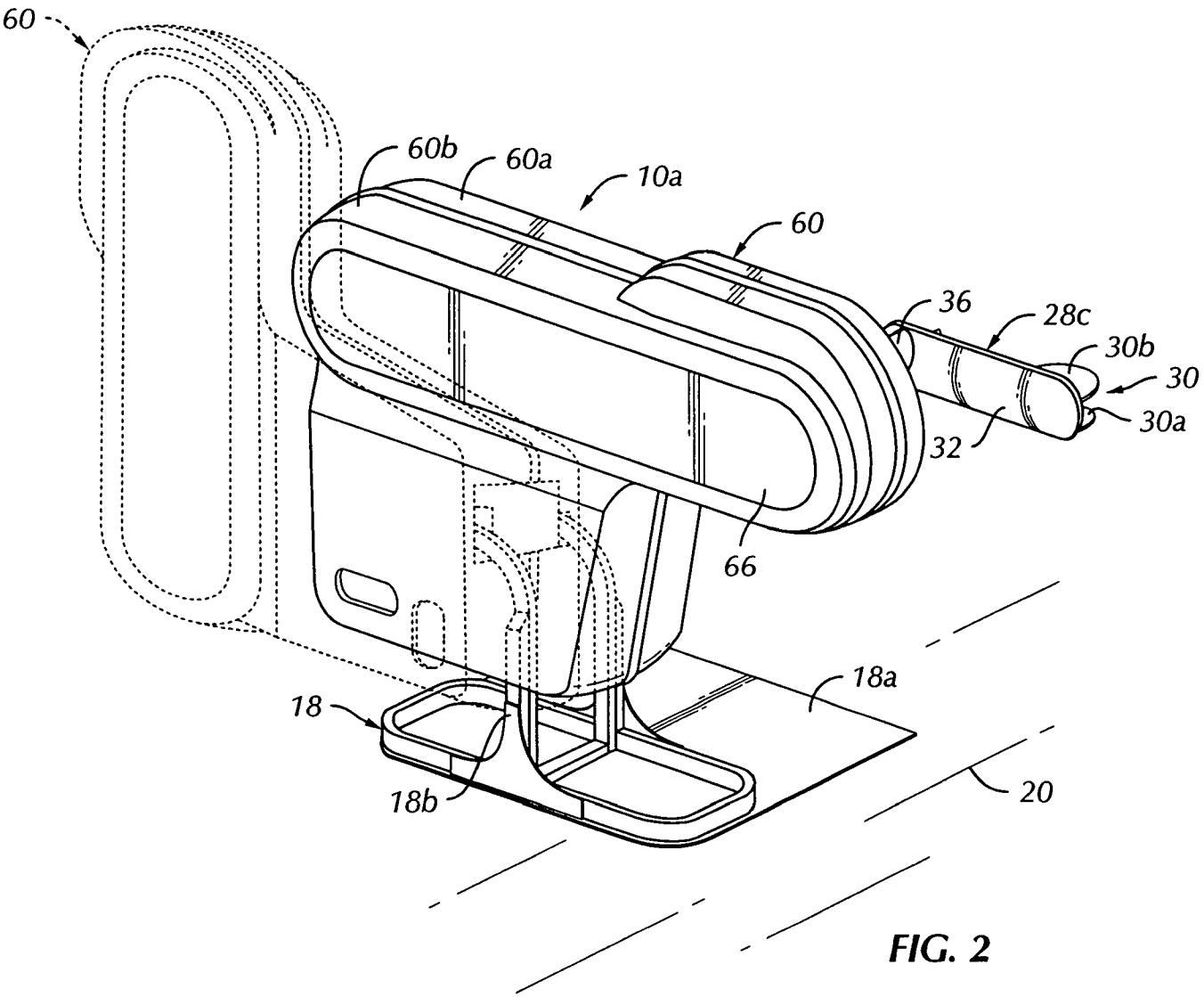
FIG. 2 is a top perspective view of a first lifter portion of the spa cover lifter shown in FIG. 1.

Referring to FIGS. 1-3, in the preferred embodiment, an arm housing 60 covers at least portions of the drive mechanism 16 and the lifting arm assembly 28. The arm housing 60 preferably prevents users, bystanders or other objects from contacting or accessing several moving parts of the spa cover lifter 10 to prevent damage to the moving parts and/or the users. The arm housing 60 is preferably constructed in a clam-shell manner including a first housing 60*a* and a second housing 60*b*. The arm housing 60 is preferably constructed of an injection molded polymeric material and has a generally light weight. The arm housing 60 is not limited to being constructed of the clam-shell arrangement including the first housing 60*a* and the second housing 60*b* or to constructions utilizing injection molded polymeric materials. The arm housing 60 may be constructed of nearly any material using nearly any process that is able to take on the general shape of the arm housing 60 and withstand the normal operating conditions of the spa cover lifter 10. For example, the arm housing 60 may be constructed of a sheet metal assembly or may be completely excluded from the spa cover lifter 10. However, the injection molded polymeric clam-shell type arm housing 60 is preferred for its relatively light weight, its ease of removal from the lifting arm assembly 28 such that an operator may perform maintenance or repairs to the lifting arm assembly 28 or drive mechanism 16 and for its ability to generally prevent bystanders or users from coming into contact with several moving parts of the lifting arm assembly 28.

In the preferred embodiment, the arm housing 60 is mounted to the lifting arm assembly 28 and is supported by at least a housing bracket 62 that permits movement of the arm housing 60 relative to the fixed base 18 during operation, as will be described in greater detail below. The housing bracket 62 is preferably mounted to the first bracket 48 such that the arm housing 60 pivots with the cover transporting assembly 28*b* as the spa cover 12 moves from the intermediate position to the storage position. The housing bracket 62 is preferably constructed of a sheet metal and is fixed to the first bracket 48. The housing bracket 62 is not limited to being constructed of sheet metal and may be constructed of nearly any generally rigid material that is able to withstand the normal operating conditions of the housing bracket 62 and take on the general shape of the housing bracket 62. The housing bracket 62 also preferably prevents the arm housing 60 from coming into contact with moving parts of the lifting arm assembly 28 during operation to prevent wear, damage or failure of the arm housing 62, as will be understood by one having ordinary skill in the art.

In the preferred embodiment, the first and second housings 60*a*, 60*b* include an oblong-shaped cover clamp aperture 64 and an aperture cover 66. The cover clamp aperture 64 is generally oblong-shaped and permits the pivot shaft 36 to extend through the arm housing 60 such that the clamp 30, cover clamp arm 32 and pivot pins 34 are positioned outside of the arm housing 60 to engage the spa cover 12. The oblong-shape of the cover clamp aperture 64 permits the pivot shaft to extend out of the arm housing 60 at variable locations as a result of the adjustability of the lifting arm assembly 28, as was described above. The aperture covers 66 are utilized to cover or close the unused portion of the cover clamp aperture 64 in the assembled configuration to generally prevent access to the moving parts of the lifting arm assembly 28 and the drive mechanism 16. In addition, the cover clamp aperture 64 is preferably included in both the first and second housings 60*a*, 60*b* such that the pivot shaft 36 may extend through either the first or second housings 60*a*, 60*b*, depending upon the side of the spa 14 the first or second lifter portions 10*a*, 10*b* are positioned. The aperture covers 66 are preferably formed of an injection molded polymeric panel that is relatively light weight and may be cut and adapted depending upon where the pivot shaft 36 extends through the arm housing 60, as would be obvious to one having ordinary skill in the art. Accordingly, the aperture cover 66 is preferably removably mountable to the first and second housings 60*a*, 60*b* to provide access to the lifting arm assembly 28 and drive mechanism 16 when the aperture cover 66 is removed and to generally prevent bystanders or users from coming into contact with the moving parts of the spa cover lifter 10 during operation. The arm housing 60 is not limited to inclusion of the oblong-shaped cover clamp aperture 64 or to inclusion of the aperture covers 66 and may be constructed to include several differently shaped clamp cover apertures.

Referring to FIG. 3, in the preferred embodiment, a lower housing bracket 68 is fixedly mounted between the first bracket 48 and a lower portion of the arm housing 60. The lower housing bracket 68 preferably provides stability between the first bracket 48 and the arm housing 60 to generally prevent contact of the lower portion of the arm housing 60 and moving components of the spa cover lifter 10. The lower housing bracket 68 preferably includes glide panels 69 mounted to lower sides that may come into contact and slide against the fixed base 18 as the spa cover lifter 10 moves between the closed, intermediate and storage positions. The lower housing bracket 68 is preferably constructed of a sheet metal assembly but is not so limited and may be constructed of a generally polymeric, wood or nearly any other material that is able to withstand the normal operating conditions of the lower housing bracket 68 and perform the general functions of the lower housing bracket 68. The lower housing bracket 68 generally prevents a slight external force applied to the lower portion of the arm housing 60 from pushing a portion of the arm housing 60 into the moving components of the lifting arm assembly 28 and aids in guiding the movement of the arm housing 60 relative to the fixed base 18. The spa cover lifter 10 is not limited to the inclusion of the lower housing bracket 68 or the glide panels 69 and may include a relatively stiff arm housing 60 that prevents flexing or movement of the arm housing 60 toward the lifting arm assembly 28 during operation or may include an alternatively sized and/or shaped bracket or member to space the arm housing 60 from the moving components of the spa cover lifter 10. In addition, the glide panels 69 may be eliminated from the assembly without significantly impacting the operation of the spa cover lifter 10, however, the slide panels 69 are preferred to limit damage to the lower housing bracket 68, arm housing 60 and/or fixed base by providing a durable sliding or glide surface on the lower housing bracket 68 that may impact and slide along the upstanding leg and the horizontal leg 18*b*, 18*c* as the arm housing 60 moves relative to the fixed base 18.

Referring to FIGS. 1-3 and 8-11, the cover clamp 30 includes a first jaw 30*a*, a second jaw 30*b* and the cover clamp arm 32. The first and second jaws 30*a*, 30*b* engage and secure the cover clamp 30 to the spa cover 12 in a grasping position (FIG. 1). The first and second jaws 30*a*, 30*b* are preferably adjustably mounted to the cover clamp arm 32 to permit the cover clamp 30 to engage variably sized, angled and configured spa covers 12.

Figure 9:
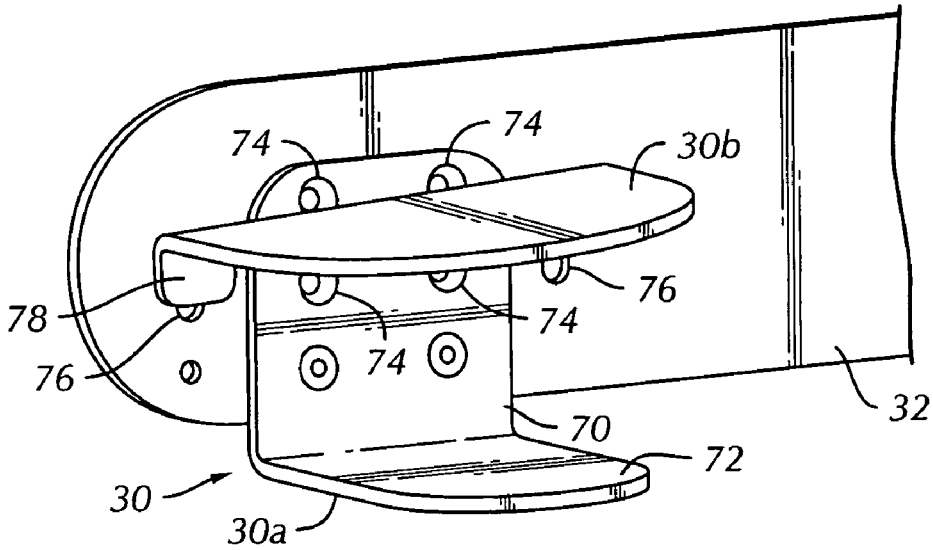
FIG. 9 is a magnified left-side perspective view of a portion of the cover clamp assembly shown in FIG. 8.
Figure 10:
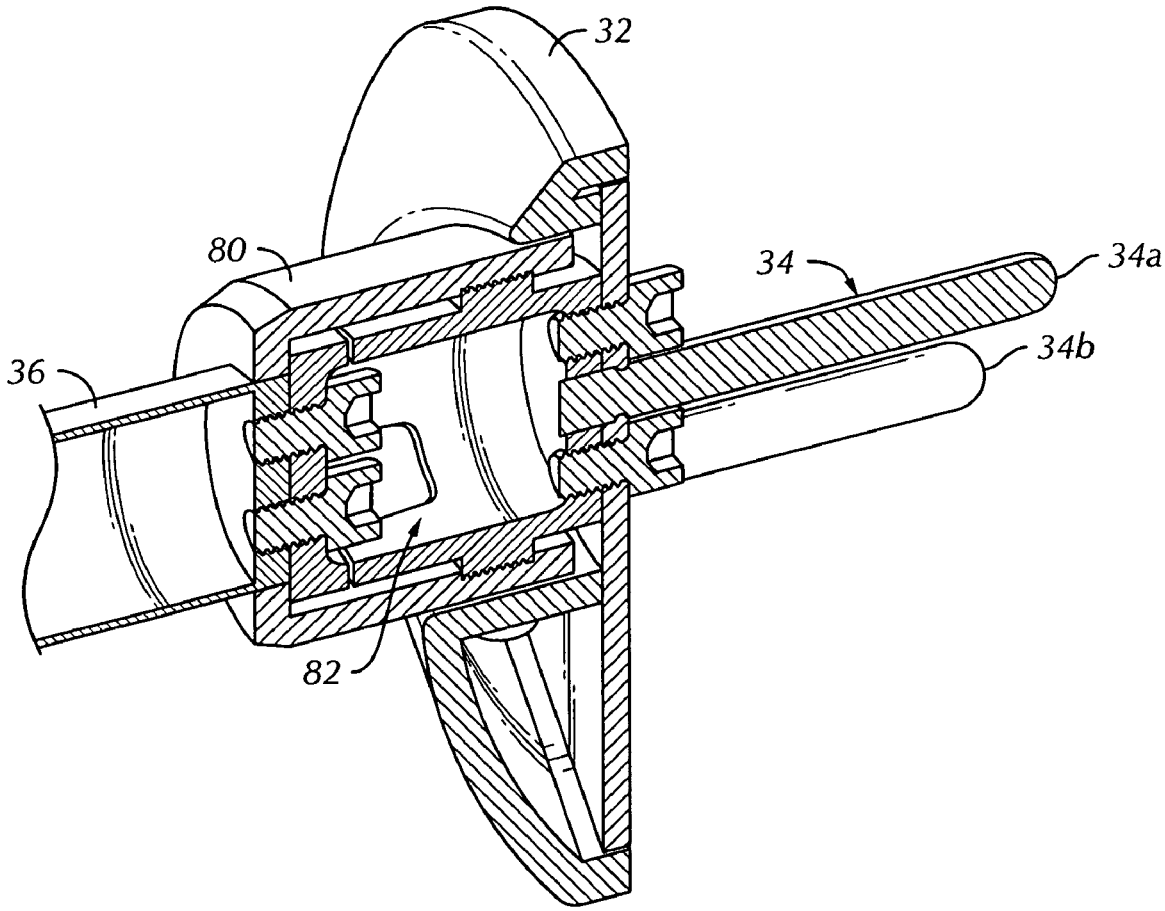
FIG. 10 is a cross-sectional view of the cover clamp assembly shown in FIG. 8, taken along line 10-10 of FIG. 8.
Figure 11:
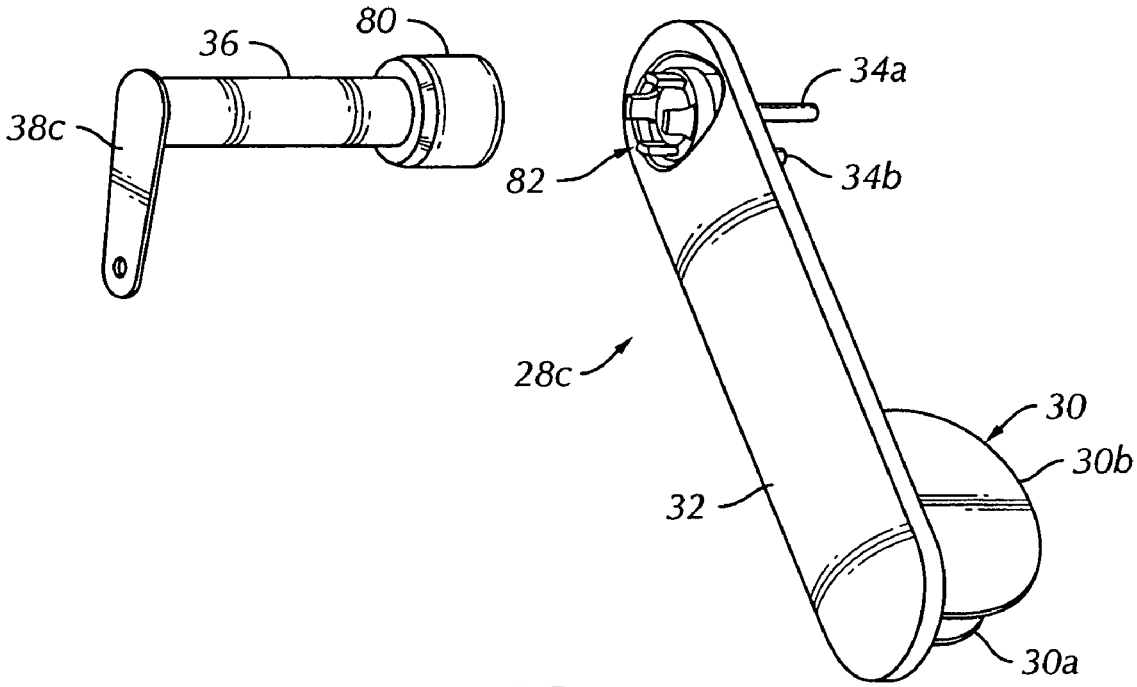
FIG. 11 is a partially exploded view of the cover clamp assembly shown in FIG. 8.

Referring to FIG. 9, the first jaw 30*a* includes a base leg 70 and a jaw leg 72. The base leg 70 includes a plurality of mounting holes 74 for mounting the first jaw 30*a* to the cover clamp arm 32. In the preferred embodiment, the base leg 70 includes six mounting holes 74 positioned on the first jaw 30*a* in pairs to permit adjustment of the location of the jaw leg 72 relative to the cover clamp arm 32 and the second jaw 30*b*. The cover clamp arm 32 includes complimentary holes (not shown) for the insertion of fasteners through the holes 74 to securely engage the first jaw 30*a* to the cover clamp arm 32. The pair of mounting holes 74 may be adjusted based upon the size, generally thickness, of the spa cover 12 such that the cover clamp 30 may firmly engage an edge of the first or second leaf 12*a*, 12*b*.

The cover clamp arm 32 also preferably includes slotted holes 76 for mounting the second jaw 30*b* to the cover clamp arm 32. Specifically, the second jaw 30*b* preferably includes a pair of mounting tabs 78 with holes (not shown) therein that each receive a fastener (not shown) through the slotted hole 76 and holes in the mounting tabs 78. The slotted holes 76 permit vertical and pitch adjustment of the second jaw 30*b* relative to the cover clamp arm 32. The vertical and pitch adjustment of the second clamp 30*b* relative to the cover clamp arm 32 and first jaw 30*a* permit height or thickness adjustment for adaptability to various spa covers 12. Specifically, the tabs 78 may be fixed to the cover clamp arm 32 at a specific position in the slotted holes 76 such that the second jaw 30*b* is generally parallel to the jaw leg 72 of the first jaw 30*a* and may be adjusted by moving the tabs 78 and fasteners relative to the or within the slotted holes 76 to change the position of the jaws relative to each other.

The jaw leg of the second jaw 30*b* may be pitched relative to the jaw leg 72 of the first jaw 30 such that they are not generally parallel. Such a pitch adjustment is preferable for spa covers 12 that have a pitched or variable thickness design. Spa covers 12 may have a variable thickness with a relatively large thickness near the hinge 12*c* and a relatively lesser thickness as the first or second leaf 12*a*, 12*b* extends towards its terminal end opposite the hinge 12*c*. Such a design is generally utilized because the leaves 12*a*, 12*b* experience relatively higher stresses and loads proximate the hinge 12*c* and may be thicker proximate the hinge 12*c* to withstand these loads in the normal operating conditions of the spa cover 12.

The clamp 30 is not limited to the above-described configuration including the first and second jaws 30*a*, 30*b*, the mounting holes 74, slotted holes 76 and mounting tabs 78. The cover clamp 30 may include nearly any configuration that permits the engagement or mounting of the cover clamp arm 32 to the spa cover 12 for moving the spa cover 12 to and between the closed, intermediate and storage positions. The above-described configuration of the cover clamp 30 is preferred based upon its adaptability and variability for different spa covers 12 and for properly engaging the spa cover 12. However, the spa cover lifter 10 is not limited to the specific cover clamp 30 described above and may include, for example, a spring-biased clamp or a mechanism that permanently fixes the cover clamp arm 32 to the spa cover 12, such as a cover clamp arm 32 that is integrally engaged or formed within one of the leaves 12*a*, 12*b* of the spa cover 12.

In the preferred embodiment, the pivot pins 34 of the cover clamp assembly 28*c* are positioned generally perpendicular relative to the cover clamp arm 32 and generally parallel to the cover clamp shaft 36. The pivot pins 34 are preferably positioned proximate the hinge 12*c* of the spa cover 12 in the grasping position. The pivot pins 34 are positioned proximate the hinge 12*c* such that when the spa cover 12 moves between the closed, intermediate and storage positions, the pivot pins 34 aid in the movement, as will be described in greater detail below. The pivot pins 34 are preferably constructed of a generally rigid, metallic material but are not so limited. For example, the pivot pins 34 may be constructed of a polymeric, wood or other generally rigid, structural material for aiding in the pivoting of the spa cover 12. In addition, the pivot pins 34 may be eliminated from the spa cover lifter 10 and the cover clamp 30 may be exclusively utilized to move and/or support the spa cover 12.

Referring to FIGS. 1 and 8-11, in the preferred embodiment, the cover clamp arm 32 is removably mounted to the pivot shaft 36. The pivot shaft 36 includes a hub 80 on an end opposite the third arm 38*c* and the cover clamp arm 32 includes engagement legs 82 on an opposite side from the pivot pins 34. The engagement legs 82 are preferably, removably mountable to the hub 80 in a bayonet-type manner. Engagement and disengagement of the cover clamp arm 32 from the pivot shaft 36 and the cover clamp 30 from the spa cover 12 permits disengagement of the spa cover 12 from the spa cover lifter 10 without removing the entire first and/or second lifter portions 10*a*, 10*b* from the area proximate the spa 14. Accordingly, if the spa cover lifter 10 becomes damaged or otherwise is in need of inspection or maintenance, the hub 80 may be disengaged from the engagement legs 82 and the cover clamp 30 may be disengaged from the spa cover 12 such that the spa cover lifter 10 is not engaged with the spa cover 12 and a user may manually remove the spa cover 12 from the spa 14 in a typical manner. In addition, during assembly, the first and second lifter portions 10*a*, 10*b* may be positioned relative to the spa 14 and spa cover 12 prior to engaging the cover clamp assembly 28*c* to the spa cover 12. However, the cover clamp arm 32 is not limited to being releaseably engageable with the cover clamp arm 32 using the hub 80 and engagement legs 82 and may be fixed to the pivot shaft 36 or may be releaseably mountable to the pivot shaft 36 using an alternative mechanism.

Referring to FIGS. 1, 2, 12 and 13, in the preferred embodiment, the spa cover lifter 10 includes a controller 84 in communication with the drive mechanism 16. In addition, a remote control 86 is preferably in communication with the controller 84 for sending a signal to the controller 84 to actuate the drive mechanism 16 to drive the lifting arm assembly 28 to automatically move the cover 12 from the closed position to the storage position. The remote control 86 may be comprised of nearly any type of remote control that is able to send a signal or various signals to the controller 84 to direct the controller 84 to actuate the drive mechanism 16 or to direct typical functions of the spa 14. For example, the remote control 86 may be actuated by a user to direct the controller 84 to drive the drive mechanism 16 for moving the spa cover 12 from the closed position to the intermediate position and to the storage position. In addition, an alternative signal may be sent from the remote control 86 to direct the controller 84 to actuate the drive mechanism 16 to move the spa cover 12 from the storage position to the intermediate position to the closed position. In addition, the remote control 86 may include a cancel signal to stop or cancel the movement of the drive mechanism 16 through the controller 84. Further, the remote control 86 may include options to direct the controller 84 to control typical functions of the spa 14, including water temperature, actuation of various jets, operation of pumps, lights or other typical functions of the spa 14.

The spa cover lifter 10 is not limited to the inclusion of the remote control 86 or to the controller 84. For example, the spa cover lifter 10 may include a controller or control mechanism (not shown) that is mounted directly to the first and/or second lifter portions 10*a*, 10*b* or to the spa 14. However, the remote control 86 is preferred for the convenience of the user, for example, if the spa 14 is located in an outdoor environment that has an inclement or variable weather pattern and the remote control 86 may be utilized in conjunction with a fixed controller mounted to the spa cover lifter 10 or spa 14. Preferably, a user may open and close the spa cover 12 using the remote control 86, eliminating the need for the user to manually open and close the spa cover 12 or to even be within arms reach of or visual communication with the spa cover 12 and spa 14.

Referring to FIGS. 1-7, 12 and 13, a safety shutoff mechanism 88 is preferably in communication with the controller 84 for transmitting a stop signal to the controller 84 when one of the spa cover 12, lifting arm assembly 28, and drive mechanism 16 encounters an obstacle during operation. The controller 84 preferably cuts power to the drive mechanism 16 upon receipt of the stop signal from the safety shutoff mechanism 88. Upon receipt of the stop signal from the safety shutoff mechanism 88, the controller 84 preferably cuts power to the drive mechanism 16 to prevent further movement of the spa cover 12, lifting arm assembly 28 and drive mechanism 16. In the preferred embodiment, the safety mechanism 88 includes a safety instrument 90, comprised of a strain gage 90, mounted to the lifting arm assembly 28 and a lookup table 92. The controller 84 receives operating measurements from the safety instrument 90, preferably strain measurements from the strain gauge 90, when the lifting arm assembly 28 moves the spa cover 12 from the closed position to the storage position and compares the operating measurements, preferably strain, to the operating measurements, preferably strain measurements or data, in the lookup table 92 to determine if the measurements are outside of an acceptable range. The controller 84 disables or cuts power to the drive mechanism 16 when the measurements are outside of the acceptable range in the lookup table 92.

Figure 13:
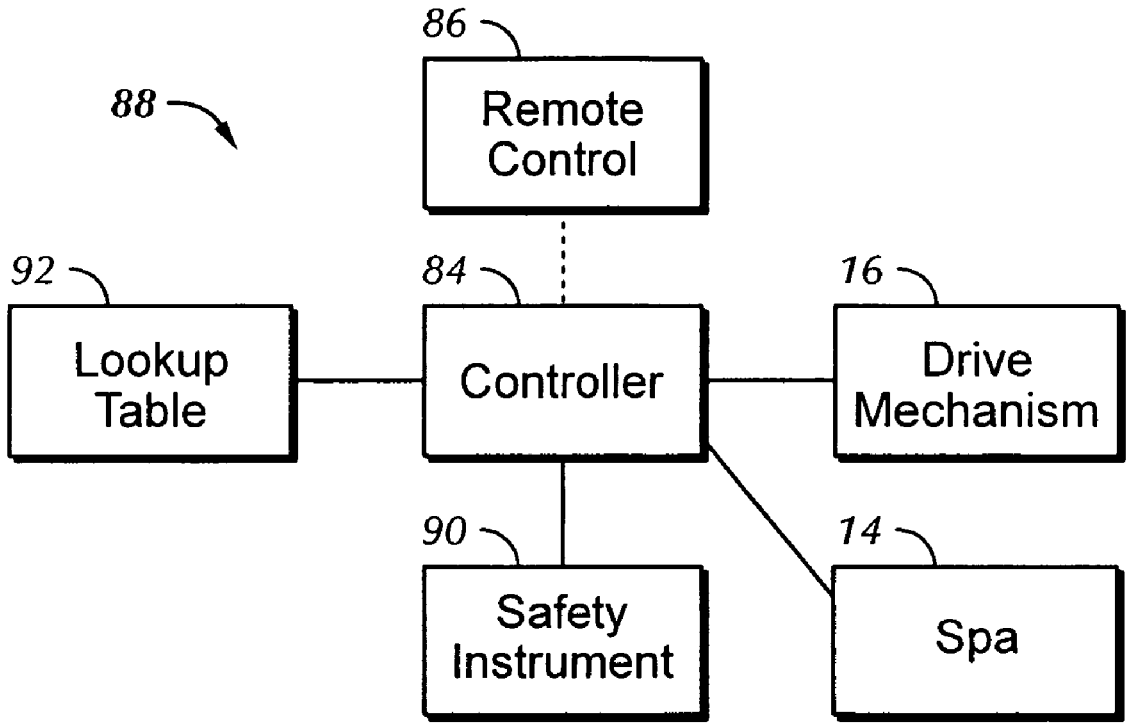
FIG. 13 is a block diagram of a control system of the spa cover lifter shown in FIG. 1.

Referring to FIGS. 12 and 13, in the preferred embodiment, the strain gauge 90 is mounted to the actuator mount beam 22 and the actuator mount beam 22 is pivotably mounted at its ends to the pivoting bracket 24 by the pivot pins 25. Based upon this arrangement, during use, the actuator mount beam 22 reacts forces from the linear actuator 16 generally perpendicularly to the attachment face at the pin and lug arrangement 26, resulting in the actuator mount beam 22 acting as a simple beam. The lookup table 92 is preferably created by driving the spa cover lifter 10 through several opening and closing cycles with a specific spa cover 12 to create the lookup table 92, comprised of the strains generally encountered by the actuator mount beam 22 during the opening and closing sequence. In normal operation, the controller 84 is provided with samples of strains from the strain gauge 90 during the opening and closing of the spa cover 12, which should fall within a predetermined range of the strains stored in the lookup table 92 at any specific position of the spa cover lifter 10 and/or spa cover 12. If the strain readings from the strain gauge 90 fall outside of the acceptable range when compared by the controller 84 to the values in the lookup table 92, the controller 84 sends the stop signal to the drive mechanism 16 to stop the opening or closing of the spa cover 12.

The safety mechanism 88 is not limited to inclusion of the strain gage 90 or to the strain gage 90 mounted to the actuator mount beam 22. For example, the strain gage 90 may be mounted to nearly any portion of the spa 14, spa cover 12 or spa cover lifter 10 that are subjected to loads while the spa cover 12 is moving between the closed, intermediate and storage positions. In addition, the safety mechanism 88 may not include the strain gage 90 and may collect another measurement from an instrument attached to the spa 14, spa cover 12 or spa cover lifter 10 that provides an indication of when the spa cover 12 or spa cover lifter 10 impacts an object while in motion. For example, the safety shutoff mechanism 88 may include a current sensing instrument (not shown) mounted to the linear actuator 16 that collects current draw measurements, provides the measurements to the controller 84 and the controller 84 compares these measurements to the lookup table 92, which includes current draw measurements from a typical spa cover lifter movement. Alternatively, the safety mechanism 88 may include an optical safety system that observes the movement of the spa cover 12 and/or spa cover lifter 10 to visually check for obstacles during the opening and closing sequences.

The remote control 86 or an alternative control panel may include a reset button to permit the spa cover lifter 10 to continue the opening and/or closing cycle after power has been cut by the safety shutoff mechanism 88, depending upon an observation by the user. The safety shutoff mechanism 88 generally improves the safety of the spa cover lifter 10. For example if an obstacle is encountered by the spa cover 12, the lifting arm assembly 28 or the linear actuator 16 during operation, the strain gauge 90 sends extreme strain measurements to the controller 84 because of the additional load applied to push against the obstacle. When the extreme strain measurements are compared by the controller 84 to the strain values in the lookup table 92, the extreme strains fall outside of a predetermined range and the stop signal is sent to the drive mechanism 16. For example, if an object or an individual comes into contact with or becomes entangled in the spa cover 12, the lifting arm assembly 28 or the linear actuator 16 during operation, the safety shutoff mechanism 88 automatically sends the stop signal to the drive mechanism 16 to typically prevent injury to the user or operator or damage to the spa cover lifter 10 or spa cover 12.

Referring to FIGS. 1-7, in operation, the spa cover 12 is positioned over the mouth 14*a* in the closed position such that the first and second leaves 12*a*, 12*b* are generally located on a cover plane 94. A first exposed face 96 of the first leaf 12*a* and a second exposed face 98 of the second leaf 12*b* are facing away from the spa 14 in the closed position. The drive mechanism or linear actuator 16 is actuated by the remote control 86 or an alternative controller to engage the lifting arm assembly 28 with the second leaf 12*b* to pivot the second leaf 12*b* about the hinge 12*c* such that the first exposed face 96 is facing the second exposed face 98 and the first leaf 12*a* and second leaf 12*b* are positioned generally parallel to the cover plane 94 in the intermediate position. Preferably, as the second leaf 12*b* moves from the closed position to the intermediate position, the first leaf 12*a* generally does not significantly change position and remains positioned over the mouth 14*a*. Such a movement generally limits the vertical sweep of the second leaf 12*b* as it moves from the closed position to the intermediate position, thereby permitting installation of the spa cover lifter 10 on a spa 14 and a spa cover 12 that may be positioned inside of a structure having a roof (not shown) or in any environment where vertical space above the spa cover 12 is limited. The drive mechanism 16 is then actuated by the remote control 86, an alternative controller or automatically based upon the initial signal, to engage the lifting arm assembly 28 with the cover 12 to pivot the cover 12 to the storage position.

In a preferred embodiment, the first and second leaves 12*a*, 12*b* are positioned generally perpendicular to the cover plane 94 in the storage position. The first and second leaves 12*a*, 12*b* are positioned generally perpendicular to the spa cover plane 94 in the storage position to generally limit the storage space required for the spa cover 12 in the storage position and to generally position the spa cover 12 in a location away from the spa 14 such that the user is easily able to enter and exit the spa 14. The spa cover 14 is not limited to a storage position wherein the first and second leaves 12*a*, 12*b* are generally perpendicular to spa cover plane 94 in the storage position. For example, the spa cover 12 may be positioned generally parallel to the spa cover plane 94 or at an angle to the spa cover plane 94 in the storage position as long as the spa cover 12 is not covering or significantly limiting access to the mouth 14*a* of the spa 14 in the storage position. For example, the spa cover 12 may simply move linearly off of the mouth 14*a* such that the leaves 12*a*, 12*b* are generally parallel to the spa cover plane 94 in a storage position.

Referring to FIGS. 1 and 7, in the preferred embodiment, the first exposed face 96 and the second exposed face 98 are in facing engagement in the intermediate position. The first and second exposed faces 96, 98 are preferably in facing engagement in the intermediate position such that the spa cover 12 is in a generally compact configuration in the intermediate position during and/or prior to movement from the intermediate position to the storage position. In addition, the generally compact configuration of the spa cover 12 in the intermediate position generally permits reduction of loads on the spa cover lifter 10 because moment arms to a center of gravity of the leaves 12*a*, 12*b* and the variety of loads seen by the spa cover lifter 10 from the weight of the spa cover 12 as the spa cover 12 moves from the intermediate to the storage position are typically increased as the spa cover 12 moves from a compact position.

Referring to FIGS. 1, 5-7 and 13, in the preferred embodiment, a start signal is sent from the remote control 86 to the controller 84 to direct the controller 84 to send a signal to the drive mechanism 16 to move the cover 12 automatically between the closed position and the storage position. As was described above, the use of the remote control 86 is generally convenient for a user in that the user may start the movement of the spa cover 12 when they are located at a distance from the spa 14.

Referring to FIGS. 1-13, in use, the spa cover 12 is positioned in the closed position covering the mouth 14*a* of the spa 14 and the first and second lifter portions 10*a*, 10*b* are secured to the ground 20 or the spa 14. The cover clamp arm 32 is engaged with the pivot shaft 36 by securing the engagement legs 82 to the hub 80 such that the cover clamp arm 32 is generally positioned with its length proximate the edge of the second leaf 12*b* and generally on the spa cover plane 94. In addition, the cover clamp arm 32 is typically positioned such that the jaw leg 72 of the first jaw 30 is positioned between the second leaf 12*b* and the mouth 14*a*. The first jaw 30*a* may be adjusted relative to the cover clamp arm 32 by arranging the complementary holes in the cover clamp arm 32 to properly position the jaw leg 72 relative to the mouth 14*a* and second leaf 12*b*. The second jaw 30*b* is then engaged with the second exposed face 98 to sandwich the second leaf 12*b* between the first and second jaws 30*a*, 30*b*. The second jaw 30*b* is fixed in a preferred position by fasteners and engagement with the slotted holes 76 at a preferred height and pitch to properly engage the second leaf 12*b*. Further, a lower pin 34*b* of the pivot pins 34 is preferably positioned between the first and second leaves 12*a*, 12*b* and an upper pin 34*a* of the pivot pins 34 is positioned proximate a top of the hinge 12*c*.

The opening and closing of the spa cover 12 is typically initiated by sending a signal from the remote control 86 or an alternative control panel to the controller 84, which in turn sends a start signal to the drive mechanism 16. The drive mechanism 16 initially moves the cover pivoting assembly 28*a* to pivot the second leaf 12*b* from the closed position to the intermediate position, generally without significantly moving the first leaf 12*a*. The lower pin 34*b* preferably engages and aids in moving the second leaf 12*b* from the closed position to the intermediate position by helping the clamp 30 move the second leaf 12*b* about the hinge 12*c* to the intermediate position.

When the spa cover 12 reaches the intermediate position, the lock arm 58 locks movement of the cover pivoting assembly 28*a* relative to the spa cover 12 and begins driving the cover transporting assembly 28*b* to move the spa cover 12 from the intermediate position to the storage position. The upper pin 34*a* preferably aids the cover clamp 30 in engaging and supporting the spa cover 12 as it moves from the intermediate position to the storage position. Specifically, in the storage position and potentially as the spa cover 12 is located close to the storage position, a portion of the weight of the spa cover 12 may be supported by the upper pin 34. In the movement from the intermediate position to the storage position, the first leaf 12*a* generally slides over a rear edge of the mouth 14*a* of the spa 14 to help guide the movement of the spa cover 12.

Referring to FIGS. 5 and 6, in operation, the lifting arm assembly 28 and linear actuator 16 work together to move the spa cover 12 to and between the closed, intermediate, and storage positions. Specifically, when the controller 84 sends the start signal to the linear actuator 16 and the clamp 30 is mounted to the second leaf 12*b* in the closed position, a threaded rod 100 of the linear actuator 16 begins to rotate and draws a drive fitting 102 toward the pivoting bracket 24. The drive fitting 102 is movably mounted to a leg of the actuator fitting 46 and movement of the drive fitting 102 toward the pivoting bracket 24 causes the actuator fitting 46 to pivot in a direction of an arrow A about a third pivoting joint 104 where the pivoting bracket 24 is pivotably mounted to the first bracket 48. The linear actuator 16 is able to pivot relative to the pivoting bracket 24 through pivoting of the actuator mount beam 22 at the pivot pins 25, thereby permitting the threaded rod 100 to move with the actuator fitting 46 as it pivots about the third pivoting joint 104. The pivoting movement of the actuator fitting 46 pushes the first actuator bar 42 toward the slotted bar 40 and causes the second actuator bar 44 to pivot about a fourth pivoting joint 106 where the second actuator bar 44 is pivotally mounted to the first bracket 48 in a direction of an arrow B. The pivotable movement of the second actuator bar 44 drives the slotted bar 40 toward the first arm 38*a* of the triangular linkage 38. The movement of the slotted bar 40 toward the first arm 38*a* results in the first arm 38*a* pivoting about a fifth pivoting joint 108 where the first arm 38*a* is pivotably mounted to the extension arm 50 in a direction of an arrow C. The pivotable movement of the first arm 38*a* urges the second arm 38*b* to pivot at its end where it is attached to the first arm 38*a* toward the first bracket 48, causes the third arm 38*c* to pivot about the pivot shaft 36 in a direction of an arrow D and causes the pivot shaft 36 to rotate the cover clamp arm 32 and attached second leaf 12*b* in the direction of the arrow D from the closed position to the intermediate position. As the second leaf 12*b* is pivoted by the cover clamp assembly 28*c* from the closed position to the intermediate position, the lower pin 34*b* engages a rear edge of the second leaf 12*b* to aid the cover clamp 30 in holding and pivoting the second leaf 12*b* relative to the first leaf 12*a*. In addition, the upper pin 34*a* is typically positioned over or on the hinge 12*c* to hold the hinge 12*c* and first leaf 12*a* in position.

Referring to FIGS. 6 and 7, when the second leaf 12*b* reaches the intermediate position or as the first and second leaves 12*a*, 12*b* begin moving from the intermediate to the storage position, the lock arm 58 locks further movement of the actuator fitting 46 relative to the first bracket 48. Accordingly, the first actuator bar 42, second actuator bar 44, slotted bar 40, triangular linkage 38 and cover clamp assembly 28*c* are also generally locked from significant movement relative to the first bracket 48. With the cover pivoting assembly 28*a* generally locked from movement relative to the first bracket 48, the cover transporting assembly 28*b* moves the spa cover 12 from the intermediate position to the storage position. From the intermediate position, the threaded rod 100 continues to draw the drive fitting 102 toward the pivoting bracket 24, causing the actuator fitting 46 to draw the first bracket 48 and attached extension arm 50 rearwardly relative to the fixed base 18. The force from the actuator fitting 46 applied at the third pivoting joint 104 causes the pivoting bracket 24 to begin to pivot in a direction of an arrow E about the first pivoting joint 24*a*, the first linkage 52 to pivot in a direction of an arrow F about the second pivoting joint 52*a* and the pivoting bracket 24 to pivot about a sixth pivoting joint 110 in a direction of an arrow G at its pivotable attachment to the first bracket 48. The pivoting movement of the first bracket 48 is guided by the pivoting bracket 24 and first linkage 52 such that the cover clamp assembly 28*c* begins to lift the hinge 12*c* off of its position proximate the spa 24 and the terminal ends of the first and second leaves 12*a*, 12*b* begin to slide over the rear edge of the spa 14. The cover transporting assembly 28*b* continues to rotate until the spa cover 12 is in the storage position (dashed in FIG. 7), wherein the extension arm 50 is oriented generally vertical relative to the ground or support surface 20. In addition, in the preferred storage position, the upper pivot pin 34*a* aids in supporting the weight of the spa cover 12 in cooperation with the clamp 30. To return the spa cover 12 to the closed position, the controller 84 sends a closing signal to the linear actuator 16, which drives the threaded rod 100 to move the drive fitting 102 toward the terminal end of the threaded rod 100.

Referring to FIGS. 1-7, 12 and 13, when the spa cover 12 is moving to and from the closed, intermediate and storage positions, the safety shutoff mechanism 88 is able to cut power to the linear actuator 18 through the controller 84 if or when the spa cover 12, the lifting assembly 28 or the linear actuator 16 come into contact with an obstacle or are otherwise blocked from their typical movements. Specifically, the operation of the spa cover lifter 10 causes the linear actuator 16 to apply forces to the actuator mount beam 22 through the pin and lug arrangement 26. Based upon beam bending theory, as is relatively well known to one having ordinary skill in the art, the bending and strains encountered by the actuator mount beam 22 are measured using the strain gauge 90 at predetermined intervals and are transmitted to the controller 84. The controller 84 compares the measured strain from the strain gauge 90 to the associated values in the lookup table 92 depending upon where in the opening or closing cycle the spa cover lifter 10 is located. If the measured strains from the strain gage 90 fall outside of a predetermined range of the values in the lookup table 92, the controller 84 automatically cuts power to the linear actuator 16 and the spa cover lifter 10 halts movement of all of its moving components. Accordingly, if an object is positioned proximate the spa 14 that is impacted when the spa cover 12 is lowered to the storage position, the additional strains resulting from forces applied through the spa cover 12, the lifting arm assembly 28 and linear actuator 16 are sensed on the actuator mount beam 22 by the strain gage 90 and transmitted to the controller 84, which compares the sensed strains to the strains in the lookup table 92 and sends the stop signal to the linear actuator 16 is the sensed strains are outside of a predetermined range. Permitting the linear actuator 16 to drive the spa cover lifter 10 even when obstacles are encountered is a potential safety hazard for the spa cover lifter 10 and/or operators and other objects potentially in the path of the moving components of the spa cover lifter 10.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention, as defined by the appended claims.

We claim:

1. A method of moving a spa cover with a spa cover lifter from a closed position covering a mouth of a spa to a storage position exposing the mouth, the spa cover including a first leaf pivotably mounted to a second leaf at a hinge and the spa cover lifter including a lifting arm assembly, a drive mechanism and a controller, the method comprising the steps of:

a. positioning the spa cover over the mouth in a closed position such that the first leaf and the second leaf are generally located on a cover plane, a first exposed face of the first leaf and a second exposed face of the second leaf facing away from the spa in the closed position;

b. actuating the drive mechanism to engage the lifting arm assembly with the second leaf to pivot the second leaf about the hinge such that the first exposed face is facing the second exposed face and the first leaf and the second leaf are positioned in an intermediate position; and c. actuating the drive mechanism to engage the lifting arm assembly with the cover to pivot the cover to the storage position.

2. The method of claim 1 wherein the first leaf and the second leaf are positioned generally perpendicular to the cover plane in the storage position.

3. The method of claim 1 wherein the controller sends a signal to the drive mechanism to automatically move the cover from the closed position to the storage position.

4. The method of claim 1 wherein the first exposed face and the second exposed face are in facing engagement in the intermediate position.

5. The method of claim 1 comprising the further step of:

d. sending a start signal with a remote control to the controller, controller sending a signal to the drive mechanism to move the cover between the closed position and the storage position upon receipt of the start signal.

6. The method of claim 1 comprising the further step of:

d. sending a stop signal from a safety shutoff mechanism to the controller when one of the cover, the lifting arm assembly and the driving mechanism impacts an obstacle when moving from the closed position to the storage position, the controller cutting power to the drive mechanism upon receipt of the stop signal.

7. The method of claim 1 wherein the first leaf and the second leaf are positioned generally parallel to the cover plane in the intermediate position.

* * * * *

UNITED STATES PATENT AND TRADEMARK OFFICE

CERTIFICATE OF CORRECTION

PATENT NO. : 7,600,272 B2
APPLICATION NO. : 11/337297
DATED : October 13, 2009
INVENTOR(S) : Coleman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 935 days.

Signed and Sealed this

Fifth Day of October, 2010

David J. Kappos

David J. Kappos
*Director of the United States Patent and Trademark Office*